US010124610B2

(12) United States Patent
Uchida et al.

(10) Patent No.: US 10,124,610 B2
(45) Date of Patent: Nov. 13, 2018

(54) PRINTING APPARATUS AND CONTROL METHOD

(71) Applicant: CANON KABUSHIKI KAISHA, Tokyo (JP)

(72) Inventors: Haruo Uchida, Yokohama (JP); Shuichi Tokuda, Kawasaki (JP); Atsushi Ikeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/046,528

(22) Filed: Feb. 18, 2016

(65) Prior Publication Data

US 2016/0257144 A1 Sep. 8, 2016

(30) Foreign Application Priority Data

Mar. 3, 2015 (JP) ..... 2015-041777

(51) Int. Cl.
*B41J 13/00* (2006.01)
*B41J 11/42* (2006.01)

(52) U.S. Cl.
CPC ..... *B41J 13/0009* (2013.01); *B41J 11/42* (2013.01)

(58) Field of Classification Search
CPC ..... B41J 15/048; B41J 2/325; B41J 3/4075; B41J 15/042; B41J 29/26; B41J 2202/37; B41J 2/32; B41J 13/0009; B41J 13/00; B41J 15/22; B41J 15/165; B41J 15/16; B41J 15/046; B41J 15/04; B41J 29/02; B41J 11/44; B41J 11/425; B41J 11/42; B41J 11/38; B41J 11/36; B41J 11/22; B41J 11/007; B65H 41/00
See application file for complete search history.

(56) References Cited

U.S. PATENT DOCUMENTS

| | | | |
|---|---|---|---|
| 5,531,436 | A | 7/1996 | Ohyama et al. |
| 5,794,927 | A | 8/1998 | Uchida |
| 5,821,968 | A | 10/1998 | Ohyama et al. |
| 5,940,092 | A | 8/1999 | Kashimura et al. |
| 6,634,819 | B2 | 10/2003 | Uchida |
| 6,937,360 | B1 | 10/2005 | Ikeda et al. |

(Continued)

FOREIGN PATENT DOCUMENTS

| | | | |
|---|---|---|---|
| CN | 1840354 | A | 10/2006 |
| CN | 101557937 | A | 10/2009 |

(Continued)

OTHER PUBLICATIONS

Chinese Office Action dated Jul. 31, 2017 in Chinese Application No. 201610121975.9.

*Primary Examiner* — Kristal Feggins

(74) *Attorney, Agent, or Firm* — Fitzpatrick, Cella, Harper & Scinto

(57) ABSTRACT

A printing apparatus includes a conveyance roller conveying a print medium, a printhead printing an image on the print medium, a carriage supporting the printhead and movable in a direction parallel to an axial direction of the conveyance roller, and a detecting unit detecting a rotation amount of the conveyance roller. The detecting unit is a rotary encoder including a code wheel provided coaxially with the conveyance roller. The carriage can move to a position at which the carriage overlaps the code wheel in a direction perpendicular to the axial direction of the conveyance roller.

19 Claims, 9 Drawing Sheets

(56) References Cited

U.S. PATENT DOCUMENTS

| | | | | |
|---|---|---|---|---|
| 7,506,947 | B2 | 3/2009 | Uchida | |
| 8,419,155 | B2 | 4/2013 | Kawakami et al. | |
| 2005/0253920 | A1* | 11/2005 | Yoshimizu | B41J 11/42 347/217 |
| 2009/0256309 | A1* | 10/2009 | Hasegawa | G01D 5/34707 271/270 |
| 2013/0208043 | A1 | 8/2013 | Kawakami et al. | |
| 2015/0174928 | A1* | 6/2015 | Tokisawa | B41J 13/0018 347/16 |

FOREIGN PATENT DOCUMENTS

| | | | |
|---|---|---|---|
| CN | 101746159 | A | 6/2010 |
| CN | 101844689 | A | 9/2010 |
| CN | 101857154 | A | 10/2010 |
| CN | 102407689 | A | 4/2012 |
| CN | 103182841 | A | 7/2013 |
| CN | 103481664 | A | 1/2014 |
| JP | 2011-057437 | | 3/2011 |
| JP | 2013-078908 | | 5/2013 |

* cited by examiner

PRINTING APPARATUS AND CONTROL METHOD

BACKGROUND OF THE INVENTION

Field of the Invention

The present invention relates to a printing apparatus and a control method.

Description of the Related Art

In a printing apparatus represented by an inkjet printing apparatus, the conveyance accuracy of a print medium such as paper influences the image quality. To improve the conveyance accuracy of a print medium, there has been proposed a technique of controlling driving of a conveyance roller by detecting the rotation amount of the conveyance roller. Japanese Patent Laid-Open No. 2013-78908 discloses a printing apparatus that detects the rotation amount of a conveyance roller using a rotary encoder. In the printing apparatus of Japanese Patent Laid-Open No. 2013-78908, the code wheel of the rotary encoder is provided coaxially with the conveyance roller. The code wheel can also be provided on, for example, a motor that drives the conveyance roller or a gear shaft between the motor and the conveyance roller. However, when the code wheel is provided coaxially with the conveyance roller, as in Japanese Patent Laid-Open No. 2013-78908, the apparatus is hardly affected by the backlash of the gear, resulting in advantage in the detection accuracy of the rotation amount.

When the code wheel is provided coaxially with the conveyance roller, the code wheel may be located on the moving path of a carriage with a printhead. To avoid the interference between the carriage and the code wheel, the code wheel is disposed at a position outside the moving range of the carriage. The larger the width of the carriage is, the farther outside the code wheel needs to be disposed. It is therefore difficult to reduce the device width of the printing apparatus (the width of the conveyance roller in the axial direction).

SUMMARY OF THE INVENTION

The present invention reduces the device width while providing a code wheel coaxially with a conveyance roller.

According to an aspect of the present invention, there is provided a printing apparatus comprising: a conveyance roller configured to convey a print medium; a printhead configured to print an image on the print medium conveyed by the conveyance roller; a carriage configured to support the printhead and movable in a direction parallel to an axial direction of the conveyance roller; and a detecting unit configured to detect a rotation amount of the conveyance roller, wherein the detecting unit comprises a rotary encoder including a code wheel provided coaxially with the conveyance roller, and the carriage can move to a position at which the carriage overlaps the code wheel in a direction perpendicular to the axial direction of the conveyance roller.

Further features of the present invention will become apparent from the following description of exemplary embodiments (with reference to the attached drawings).

DESCRIPTION OF THE EMBODIMENTS

Figure 1:
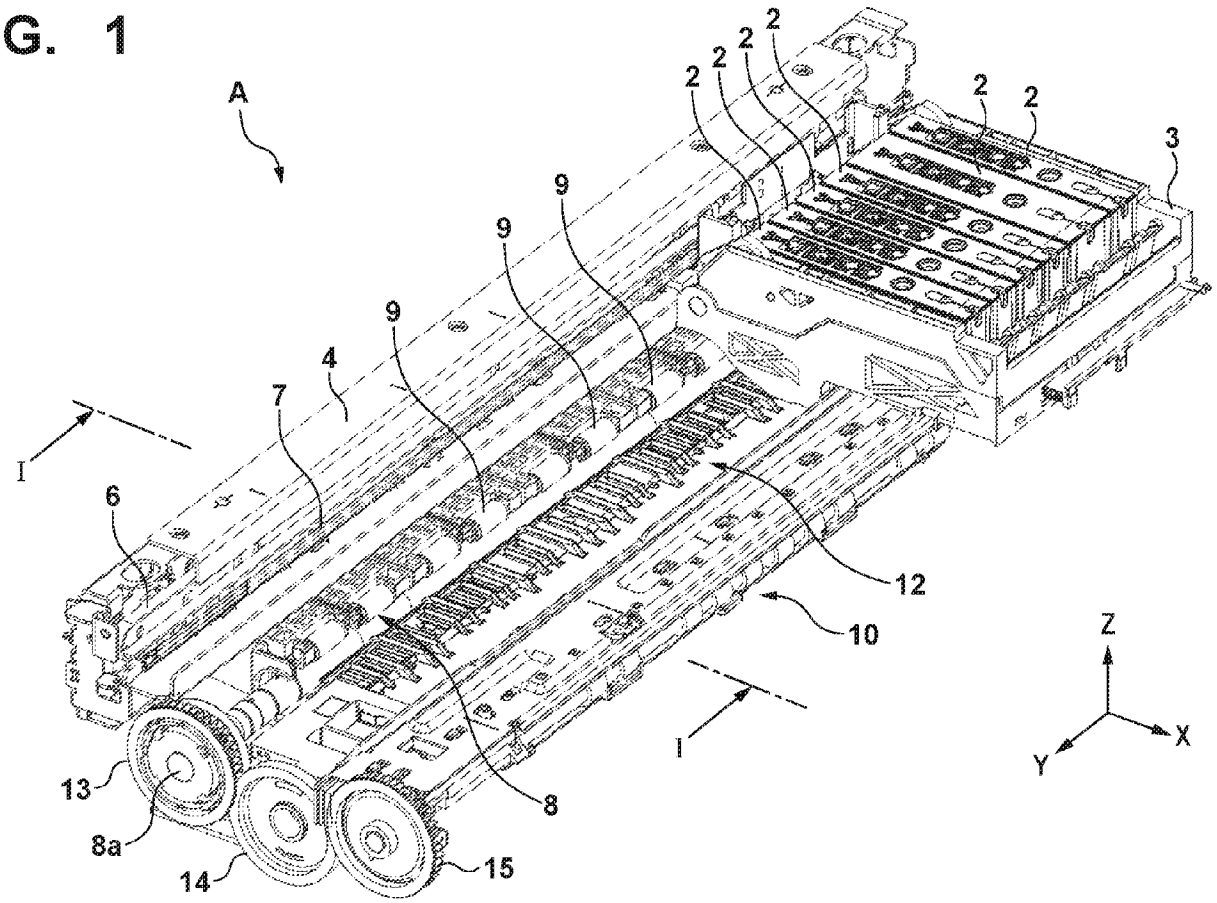
FIG. 1 is a perspective view of the arrangement of part of a printing apparatus according to an embodiment of the present invention.

An embodiment of the present invention will now be described in accordance with the accompanying drawings. Note that "printing" not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans. In this embodiment, "print medium" is assumed to be a paper sheet, but it may be a cloth, a plastic film, or the like.

In addition, "upstream side" and "downstream side" mean the upstream side and the downstream side in the conveyance direction of a print medium, unless otherwise specified. Arrows X, Y and Z in the drawings indicate three directions perpendicular to each other. When a printing apparatus according to the embodiment is placed on a horizontal plane, the X and Y directions are horizontal directions perpendicular to each other, and the Z direction is a vertical direction. The conveyance direction of a print medium at the time of image printing may be referred to as a sub-scanning direction, and a direction perpendicular to this may be referred to as a main scanning direction. In this embodiment, the Y direction corresponds to the main scanning direction, and the X direction corresponds to the sub-scanning direction.

Figure 2A:
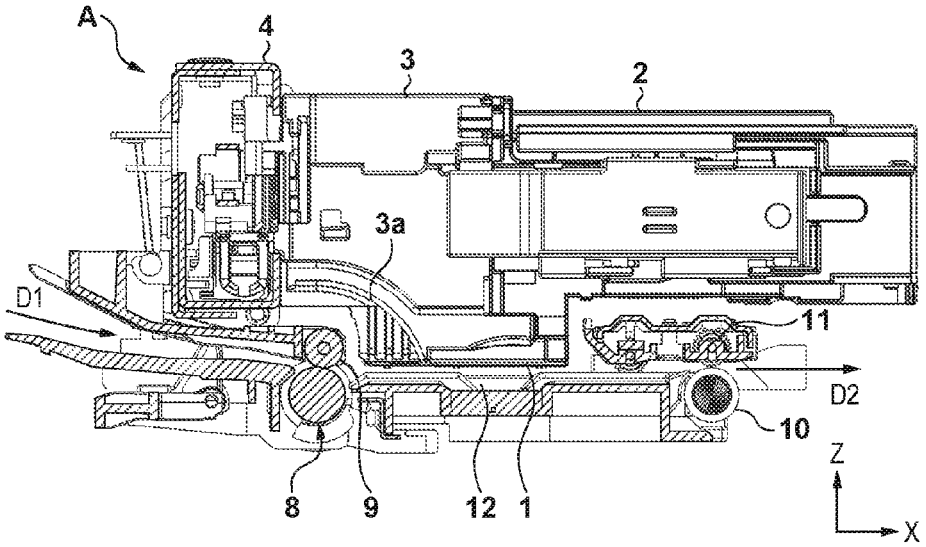
FIG. 2A is a sectional view taken along a line I-I in FIG. 1.

FIG. 1 is a perspective view schematically showing the arrangement of a printing apparatus A according to this embodiment concerning image printing. FIG. 2A is a sectional view taken along a line I-I. In this embodiment, a case in which the present invention is applied to a serial inkjet printing apparatus will be described. However, the present invention is also applicable to a printing apparatus of another type.

<Arrangement of Apparatus>

The printing apparatus A includes a feeding unit (not shown), a conveyance roller 8, a driven roller 9, a discharge roller 10, and a driven roller 11 as components configured to convey a print medium.

The feeding unit includes, for example, a tray on which a print medium is stacked, a feeding roller that feeds the print medium on the tray to the conveyance roller 8, and a separation roller that is pressed against the feeding roller and prevents erroneous multiple sheet conveyance.

The conveyance roller 8 includes a shaft 8*a* such as a metal shaft. Abrasive grain of alumina or the like is adhered to the outer surface of the shaft 8*a*. To accurately convey the print medium, processing of adhering the abrasive grain to the outer surface of the metal shaft to increase the frictional resistance to the print medium is performed, thereby improving the conveyance accuracy of the print medium. Note that the conveyance roller 8 may be formed from a shaft and a cylindrical member of rubber or the like that covers the outer surface of the shaft. The conveyance roller 8 extends in the Y direction, and its shaft is rotatably supported. The conveyance roller 8 is a driving roller to which a driving force is transmitted via a power transmission member 13. In this embodiment, the power transmission member 13 is a gear (to be sometimes referred to as a gear 13 hereinafter) provided coaxially with the conveyance roller 8, and is fixed to the shaft. The power transmission member 13 can employ any component other than a gear depending on the driving force transmission mechanism. For example, in a belt transmission mechanism, the power transmission member 13 can employ another rotation member such as a pulley. The driven roller 9 is a pinch roller that is pressed against the conveyance roller 8 and rotates. A plurality of driven rollers 9 are provided and arranged coaxially in the Y direction. The print medium feed by the feeding unit (not shown) in the direction of an arrow D1 is nipped by the nip portion between the conveyance roller 8 and the driven rollers 9 and conveyed to the downstream side in the X direction by driving of the conveyance roller 8. Note that the rotation amount of the conveyance roller 8 is detected by a detecting unit S (to be described later).

The discharge roller 10 is formed from a shaft and a cylindrical member of rubber or the like that covers the outer surface of the shaft. The discharge roller 10 is disposed on the downstream side of the conveyance roller 8, and extends in the Y direction. The discharge roller 10 is a driving roller to which a driving force is transmitted via a power transmission member 15. In this embodiment, the power transmission member 15 is a gear (to be sometimes referred to as a gear 15 hereinafter) provided coaxially with the discharge roller 10. The power transmission member 15 can employ any component other than a gear depending on the driving force transmission mechanism. In this embodiment, the driven roller 11 comprises a plurality of spurs arranged in the Y direction, which are pressed against the discharge roller 10 and rotate. The print medium conveyed by the conveyance roller 8 and the driven rollers 9 passes between a platen 12 and a printhead 1. The print medium is then conveyed by the discharge roller 10 in the direction of an arrow D2 and discharged.

The gear 13 and an intermediate gear 14 mesh with each other, and the intermediate gear 14 and the gear 15 mesh with each other. The driving force of a driving source such as a motor is, for example, transmitted to the gear 13 and further transmitted to the gear 15. The conveyance roller 8 and the discharge roller 10 can share the driving source. Instead, the conveyance roller 8 and the discharge roller 10 may have separate driving sources.

On the platen 12, the printhead 1 prints an image on the print medium conveyed by the conveyance roller 8. In this embodiment, the printhead 1 is an inkjet printhead that includes orifices for discharging ink and can print an image by the ink. The printhead 1 can be configured to, for example, apply heat to the ink in the orifices using a heater or the like, cause film boiling of the ink by the heat, and discharge the ink from the orifices by a pressure change caused by the growth or shrinkage of bubbles of film boiling.

The printhead 1 is supported by a carriage 3. The printhead 1 may be separable from the carriage 3. The carriage 3 has a box shape with an open top. The printhead 1 is disposed on the bottom of the carriage 3. When viewed in the X direction, the carriage 3 extends from above the conveyance roller 8 to above the discharge roller 10. The upstream-side end of the carriage 3 is supported by a rail 4. The rail 4 is a member having a C-shaped section and extending in the Y direction. The carriage 3 can move in the Y direction according to the guide of the rail 4. In other words, the carriage 3 can move in parallel to the axial direction of the conveyance roller 8. As a result, the printhead 1 can move on the platen 12 in the Y direction.

A belt 6 and a code strip 7 are disposed in the rail 4. The belt 6 is an endless belt included in the belt transmission mechanism, and is disposed to travel in the Y direction by the driving force from the driving source such as a motor. The carriage 3 is fixed to part of the belt 6, and moves in the Y direction as the belt 6 travels. The code strip 7 is a detected body included in a linear encoder, and extends in the Y direction. An encoder sensor that reads the code strip 7 is mounted on the carriage 3. The position of the carriage 3 can be specified based on the detection result of the encoder sensor.

An ink tank 2 storing ink to be supplied to the printhead 1 is interchangeably mounted on the carriage 3. In this embodiment, a plurality of ink tanks 2 are mounted. However, one ink tank 2 may suffice. The one ink tank 2 may store one or a plurality of types of inks. In this embodiment, six ink tanks 2 are mounted on the carriage 3 and arranged in the Y direction. The ink tanks 2 store different types of inks. Ink types include, for example, colors, dye/pigment inks, and the like.

Figure 3:
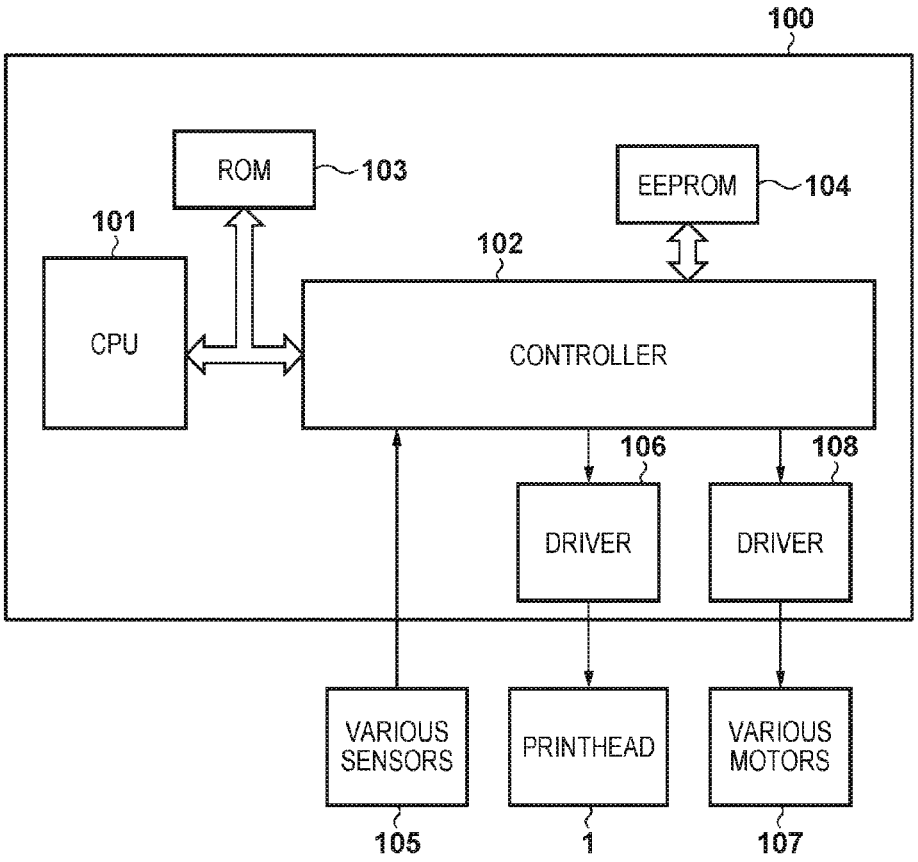
FIG. 3 is a block diagram of the control circuit of the printing apparatus shown in FIG. 1.

The arrangement of the control system of the printing apparatus A will be described with reference to FIG. 3. FIG. 3 is a block diagram of a control circuit 100 that controls the printing apparatus A. Although the control circuit 100 controls the operation of each mechanical component of the printing apparatus A, only portions concerning the description of the embodiment will be explained here. A CPU 101 controls the entire printing apparatus A. A controller 102 supports the CPU 101 and controls driving of various motors 107 and the printhead 1 in accordance with the detection results of various sensors 105.

A ROM 103 stores various kinds of data, the control program of the CPU 101, and the like. An EEPROM 104 stores various kinds of data and the like. Note that the ROM 103 and the EEPROM 104 may employ other storage devices.

A driver 108 drives the various motors 107. The various motors 107 include, for example, a motor that drives the feeding unit, a motor that drives the conveyance roller 8, a motor that moves the carriage 3, and the like. A driver 106 drives the printhead 1. The various sensors 105 include the encoder sensor of the above-described linear encoder, an encoder sensor 18 of the detecting unit S (to be described later) a sensor disposed in the conveyance path of the print medium to detect the print medium, and the like.

Image printing control by the control circuit 100 can be done, for example, as follows. When printing an image on a print medium, the conveyance roller 8 is driven to convey a print medium P to a row position (a print position in the X direction) at which the image is to be formed. Next, the carriage 3 is moved to a print position in the Y direction, and simultaneously, the printhead 1 prints the image. Subsequently, the image is printed by repeating this operation. That is, when printing an image on a print medium, the conveyance roller 8 intermittently conveys the print medium, and the printhead 1 prints the image during the stop of print medium conveyance by the conveyance roller 8.

<Detecting Unit>

Figure 2B:
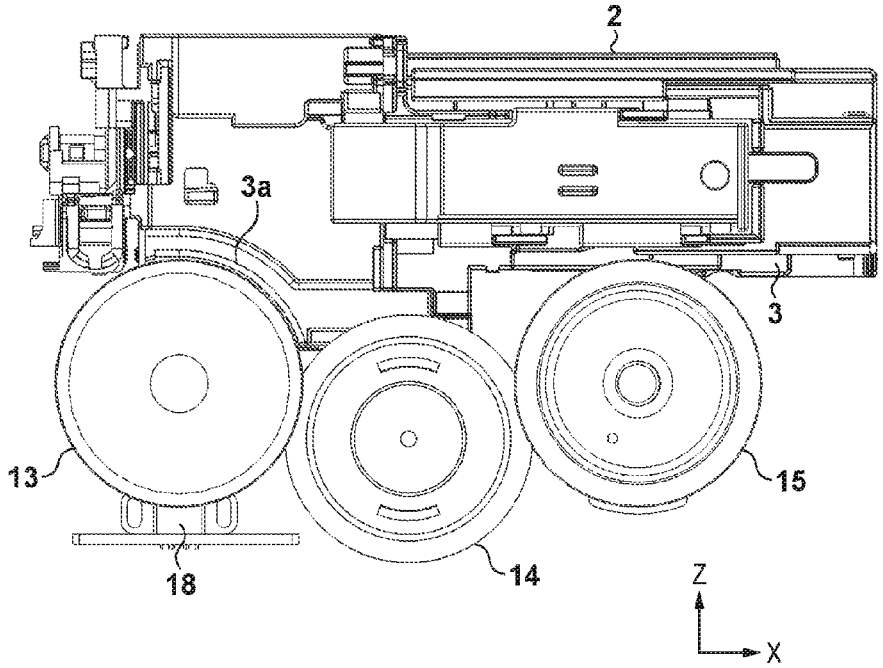
FIG. 2B is an explanatory view of the arrangement of part of the printing apparatus shown in FIG. 1.
Figure 4A:
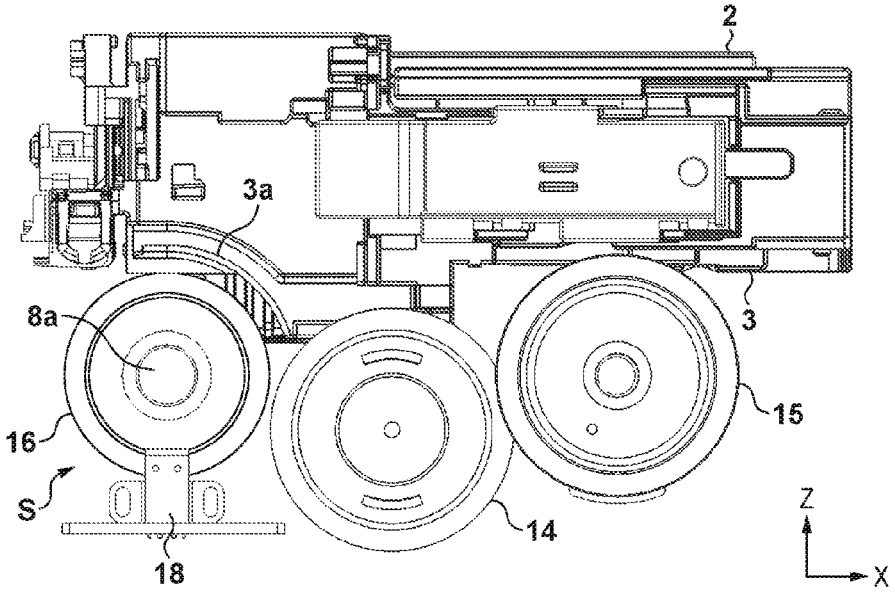
FIGS. 4A and 4B are explanatory views of the arrangement of part of the printing apparatus shown in FIG. 1.
Figure 5A:
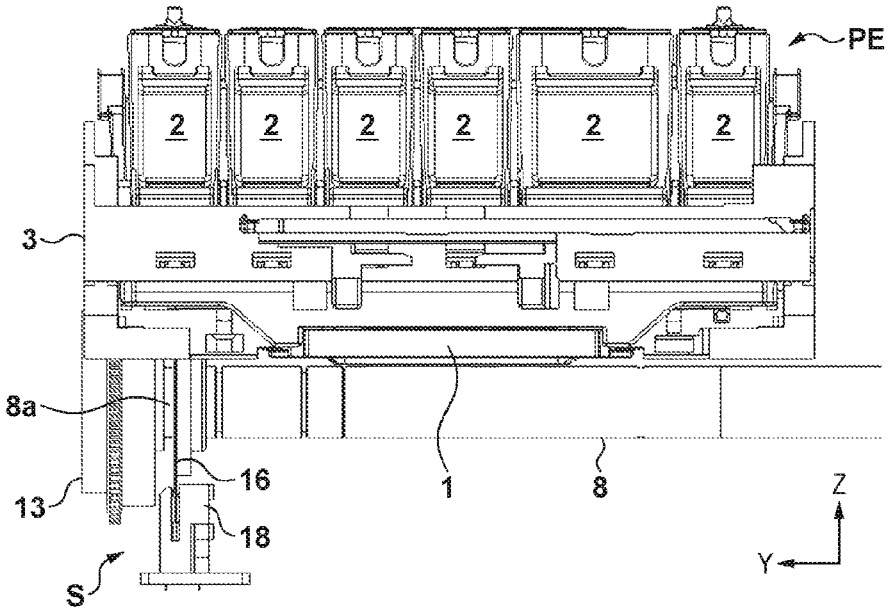
FIGS. 5A and 5B are explanatory views of the arrangement of part of the printing apparatus shown in FIG. 1.

The conveyance accuracy of the print medium by the conveyance roller 8 influences the image quality. The arrangement of the detecting unit S that detects the rotation amount of the conveyance roller 8 will be described with reference to FIGS. 2B, 4A, and 5A. FIG. 2B is a side view showing the arrangement around the gear 13 viewed in the Y direction. FIG. 4A is a view showing a state in which the gear 13 is detached in FIG. 2B. FIG. 5A is a view showing the arrangement around the detecting unit S viewed in the X direction.

The detecting unit S is a rotary encoder including a code wheel 16 and the encoder sensor 18. The code wheel 16 is provided coaxially with the conveyance roller 8. In this embodiment, the code wheel 16 is fixed to an end of the shaft 8*a*. When the code wheel 16 is provided coaxially with the conveyance roller 8, the rotation amount of the conveyance roller 8 can be detected at an accuracy higher than in a structure that attaches the code wheel 16 to the gear shaft of the intermediate gear 14 or a structure that attaches the code wheel 16 to the output shaft of a motor.

As for the positional relationship between the code wheel 16 and the gear 13, the gear 13 is arranged outside the code wheel 16 in this embodiment. However, the gear 13 may be arranged inside the code wheel 16. The encoder sensor 18 is a sensor that reads the code wheel 16. In this embodiment, the encoder sensor 18 is fixed at a position under the code wheel 16.

<Moving Range of Carriage>

Figure 4B:
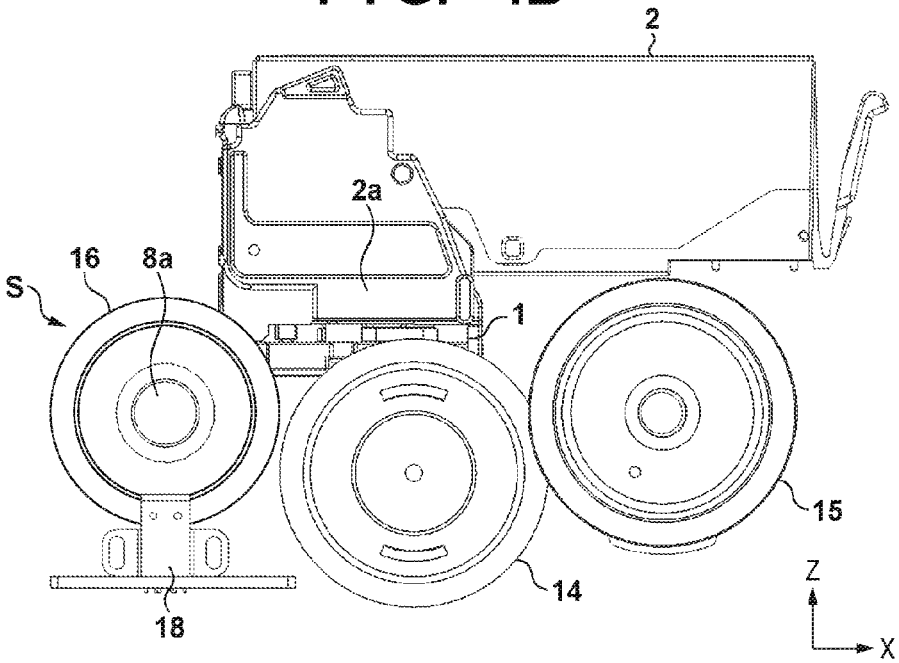
Figure 5B:
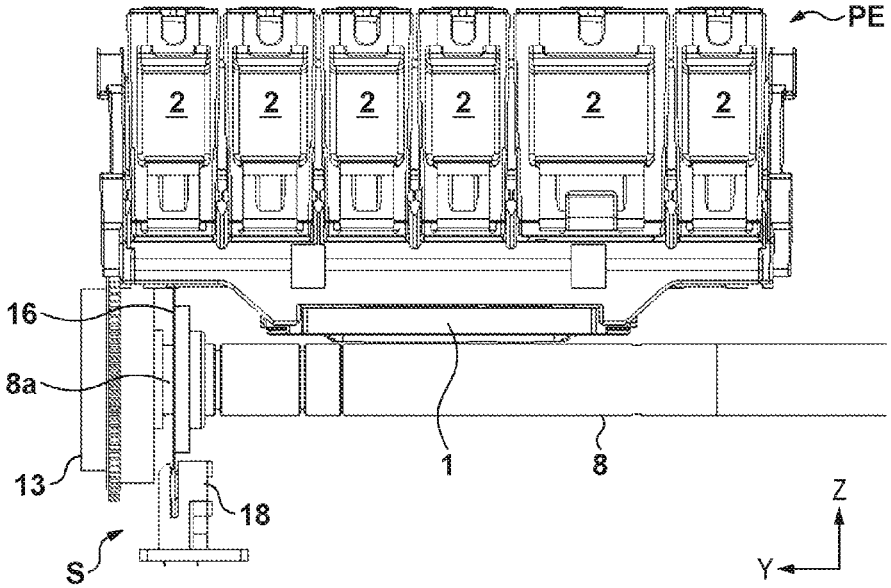

The moving range of the carriage 3 will be described with reference to FIGS. 4A to 5B. FIG. 4B is a view without the illustration of the carriage 3 in FIG. 4A. FIG. 5B is a view without the illustration of the carriage 3 in FIG. 5A. FIGS. 5A and 5B each show a state in which the carriage 3 is located at an end position PE on the side of the code wheel 16 out of the moving range of the carriage 3. The end position PE is a position at which image printing by the printhead 1 on the print medium is possible. That is, in a case in which at least a predetermined condition is met, for example, in a case in which an image to be printed at the end position PE exists, the carriage 3 is moved to the end position PE, and the printhead 1 forms the image.

Figure 6:
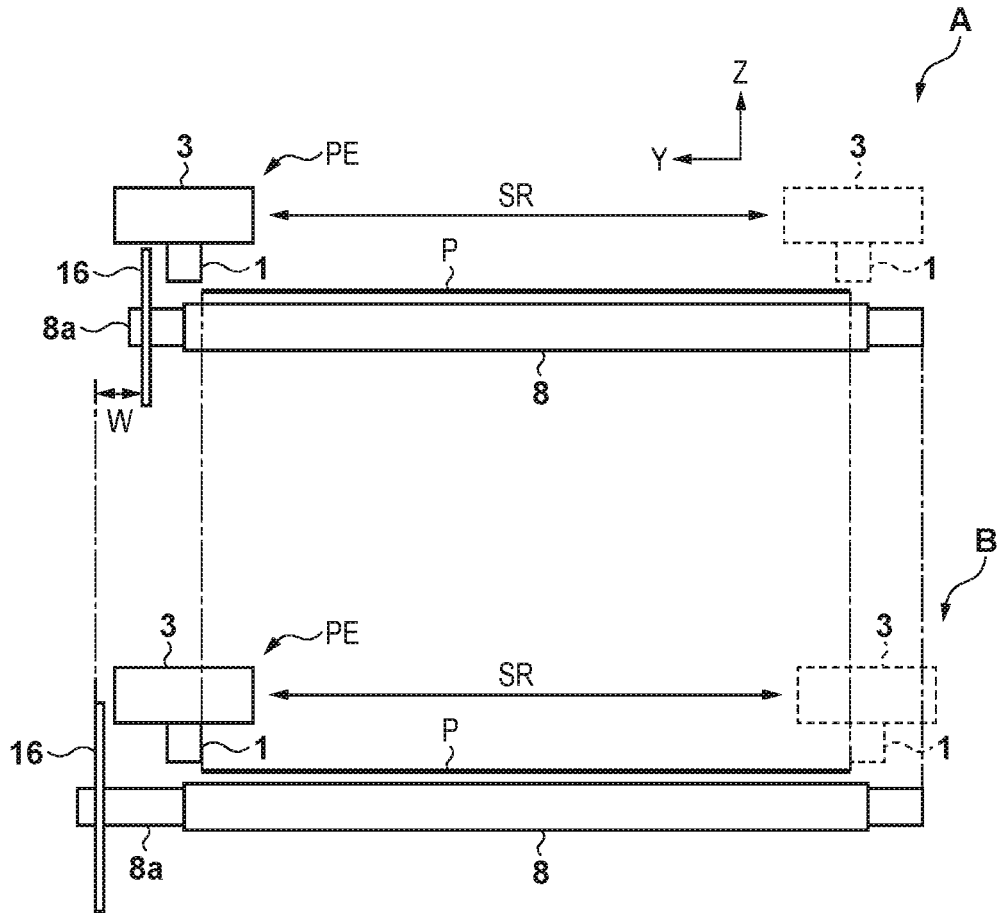
FIG. 6 is an explanatory view of the difference between the embodiment and a comparative example concerning the moving range of a carriage and the disposition of a code wheel.

As shown in FIG. 5A, at the end position PE, the carriage 3 overlaps the code wheel 16 in the Z direction. This can reduce the device width (the length in the Y direction) of the printing apparatus A. The reason will be described with reference to FIG. 6. FIG. 6 shows the positional relationship between the moving range of the carriage 3 and the code wheel 16 and the like in the printing apparatus A, and the positional relationship between the moving range of the carriage 3 and the code wheel 16 and the like in a comparative example B.

In both the printing apparatus A and the comparative example B, the moving range of the carriage 3 is a range SR of the same length. The range SR is set in accordance with the maximum size of the print medium P assumed in the printing apparatus A and the comparative example B. In the printing apparatus A, the carriage 3 overlaps the code wheel 16 in the Z direction at the end position PE. In the comparative example B, the position of the code wheel 16 is moved to outside in the Y direction to prevent the interference between the carriage 3 and the code wheel 16 at the end position PE.

In the arrangement of the printing apparatus A, since the interference between the carriage 3 and the code wheel 16 is avoided in the Z direction, the code wheel 16 can be located inside as compared to the comparative example B. In the example of FIG. 6, the code wheel 16 is located inside by a width W in the printing apparatus A, as compared to the comparative example B. The shaft 8*a* is shortened by the width W, and the device width can be reduced. In other words, the device width can be made close to the width of the maximum size of the print medium P assumed in the apparatus.

To improve the image quality, a measure of increasing ink types can be taken. When the ink types increase, the number of ink tanks 2 mounted on the carriage 3 increases, and the width of the carriage 3 in the Y direction becomes large. In the arrangement of the comparative example B, the larger the number of ink tanks 2 mounted on the carriage 3 is, the larger the device width is. On the other hand, in the printing apparatus A, even if the number of ink tanks 2 mounted on the carriage 3 increases, an increase in the device width can be suppressed.

Especially in this embodiment, as shown in FIG. 5B, the ink tanks 2 mounted on the carriage 3 overlap the code wheel 16 in the Z direction at the end position PE. This arrangement contributes to reduction of the device width. In the example of FIG. 5B, the Y-direction center of the ink tank 2 located closest to the code wheel out of the plurality of ink tanks 2 overlaps the code wheel 16 in the Z direction at the end position PE. However, an arrangement in which the ink tank 2 (for example, the second or third ink tank 2 from the left) mounted on the carriage 3 to be closer to the center in the Y direction overlaps the code wheel 16 may be employed.

Additionally, in this embodiment, as shown in FIG. 5A, the carriage 3 overlaps the gear 13 in the Z direction at the end position PE. This arrangement also contributes to reduction of the device width.

<Suppression of Increase in Device Height>

In this embodiment, since the interference between the carriage 3 and the code wheel 16 is avoided in the Z direction, the device height may increase. To suppress this, for example, a measure by the shape of the carriage 3 or reduction of the diameter of the code wheel 16 can be used.

As for the shape of the carriage 3, in this embodiment, a cutout portion 3*a* is formed in a side portion of the carriage 3, as shown in FIGS. 2B and 4A. The cutout portion 3*a* is formed across a predetermined range (the range in which the carriage 3 overlaps the code wheel 16) from a side end face of the carriage 3 in the Y direction to the center. The cutout portion 3*a* is formed into an arc shape concentric to the code wheel 16 and avoids the interference with the code wheel 16. Additionally, in this embodiment, the interference with the gear 13 is also avoided by the cutout portion 3*a*. As described above, when the cutout portion 3*a* is formed in the carriage 3, the distance between the carriage 3 and the platen 12 can be shortened, and an increase in the device height can be suppressed.

Reduction of the diameter of the code wheel 16 will be described next. When the diameter of the code wheel 16 is reduced, the distance between the carriage 3 and the platen 12 can be shortened, and an increase in the device height can be suppressed. The diameter of the code wheel 16 can be, for example, 35 mm or less, particularly, 30 mm or less. From the viewpoint of ensuring the resolution of the detecting unit S, the diameter of the code wheel 16 can be, for example, 15 mm or more, particularly, 20 mm or more. The resolution of the detecting unit S can be, for example, 300 LPI or more, particularly, 600 LPI or more. When the surface resolution of the print medium is 1,800 to 2,400 LPI, the resolution of the detecting unit S can be, for example, 600 LPI.

Figure 7A:
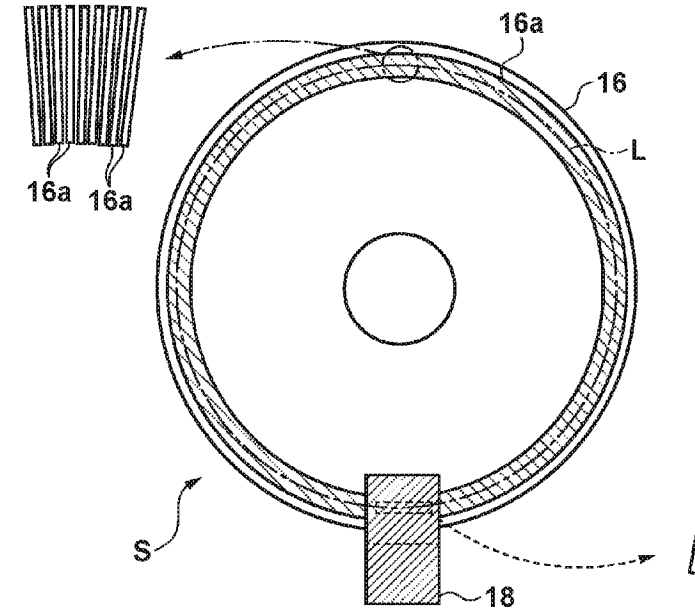
FIGS. 7A to 7D are explanatory views of a detecting unit.

When the code wheel 16 has a small diameter, and the resolution is high, the brightness contrast may lower. A measure will be described. FIG. 7A shows an explanatory view and a partially enlarged view of the detecting unit S.

As already described, the detecting unit S is a rotary encoder including the code wheel 16 and the encoder sensor 18. In this embodiment, the detecting unit S is an incremental rotary encoder, particularly, a transmission optical rotary encoder. However, it may be a rotary encoder of another type.

Transmitting portions 16*a* are annularly arranged on the periphery of the code wheel 16. Each transmitting portion 16*a* has a linear shape extending in the radial direction of the code wheel 16. A number of transmitting portions 16*a* according to the resolution are arranged at an equal pitch in the circumferential direction of the code wheel 16. The transmitting portion 16*a* is formed as a slit in the code wheel 16. A light-shielding portion is formed between adjacent transmitting portions 16*a*.

Figure 7B:
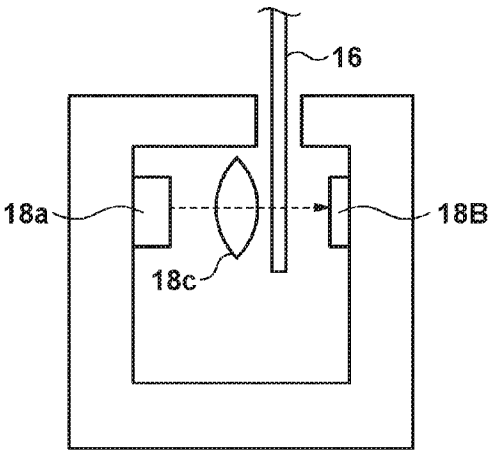
Figure 7C:
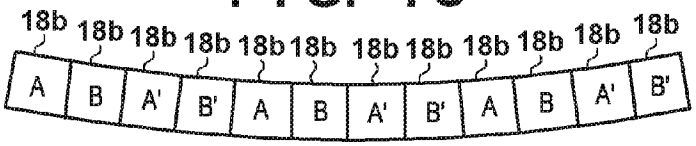

FIG. 7B is a sectional view of the encoder sensor 18. The encoder sensor 18 is a photointerrupter with a slit capable of receiving part of the periphery of the code wheel 16. A light emitting element 18*a* and a light receiving element array 18B, which are located on both sides of the code wheel 16 and face each other, are provided in the encoder sensor 18. The light emitting element 18*a* is, for example, an LED. One light emitting element 18*a* is provided here, but a plurality of light emitting elements may be provided. Light from the light emitting element 18*a* irradiates the code wheel 16 via a lens 18*c*. The light receiving element array 18B is formed by arranging a plurality of light receiving elements 18*b* in an array, as shown in FIG. 7C. The light receiving element 18*b* is, for example, a phototransistor. There are a case in which the light from the light emitting element 18*a* passes through the transmitting portion 16*a* and is received by the light receiving element 18*b* and a case in which the light is shielded by the light shielding portion and does not reach the light receiving element 18*b*. The rotation amount of the code wheel 16, that is, the rotation amount of the conveyance roller 8 is detected based on the light receiving result of the light receiving element 18*b*. Referring to FIG. 7A, a chain line L indicates a circle (to be sometimes referred to as an optical read circle) representing a designed read position of the encoder sensor 18. The optical read circle is a virtual circle with respect to the rotation center of the code wheel 16 as the center.

The plurality of light receiving elements 18*b* are roughly classified into light receiving elements A and A' for the A phase and light receiving elements B and B' for the B phase. The light receiving elements 18*b* for the A phase and light receiving elements 18*b* for the B phase are alternately arranged. The light receiving element 18*b* for the A phase and the light receiving element 18*b* for the B phase, which are adjacent to each other, are arranged such that their output signals have a phase difference of 90° in terms of an electrical angle. The light receiving element A and the light receiving element A' for the A phase, which are adjacent with the light receiving element 18*b* for the B phase being sandwiched between them, are arranged such that their output signals have a phase difference of 180° in terms of an electrical angle. This also applies to the light receiving elements B and B' for the B phase.

When the output signals from the plurality of light receiving elements 18*b* are processed by a signal processing circuit, a rectangular signal of the A phase and a rectangular signal of the B phase which have a phase difference of 90° can be obtained. The rotation direction and the rotation amount can be detected from these rectangular signals.

Figure 7D:
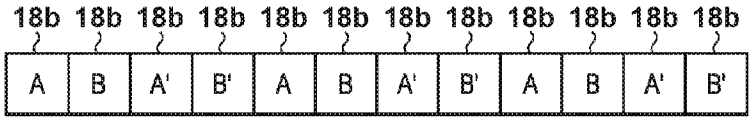
Figure 8B:
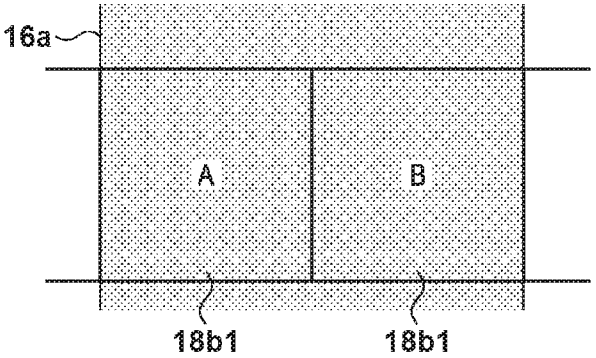
FIGS. 8A to 8C are explanatory views of a light receiving element array.
Figure 8C:
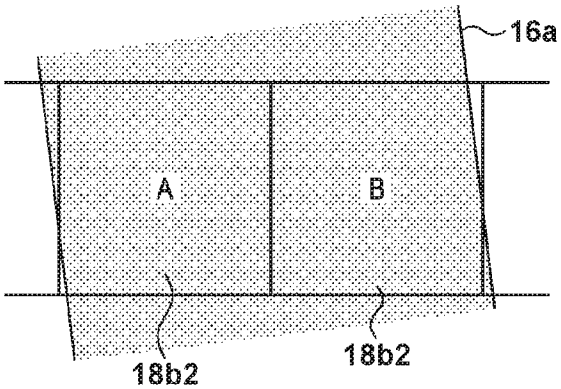
Figure 8A:
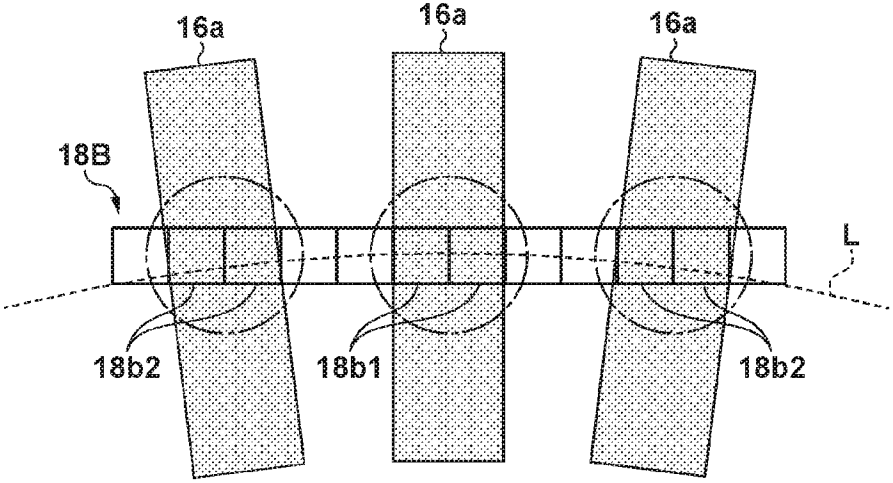

The number of light receiving elements 18*b* in the light receiving element array 18B can appropriately be selected. In general, to increase the resolution, the number of light receiving elements 18*b* tends to increase. When the number of light receiving elements 18*b* is increased to obtain a high resolution while the diameter of the code wheel 16 is reduced, the brightness contrast may lower. As a measure, in this embodiment, the plurality of light receiving elements 18*b* are arranged in an arc in the circumferential direction of the code wheel 16, as shown in FIG. 7C. FIG. 7D shows an arrangement example of a general light receiving element array. The plurality of light receiving elements 18*b* are arranged straight. The arrangement example shown in FIG. 7C can suppress a decrease in the brightness contrast as compared to the arrangement example shown in FIG. 7D. FIGS. 8A to 8C are explanatory views for explaining the reason why the brightness contrast lowers in the arrangement example shown in FIG. 7D.

As shown in FIG. 8A, when the plurality of light receiving elements 18*b* are arranged straight, the area of overlap on the transmitting portion 16*a* changes between light receiving elements 18*b*1 at the center of the light receiving element array 18B and light receiving elements 18*b*2 at an end. FIG. 8B shows the overlap between the transmitting portion 16*a* and the light receiving elements 18*b*1 at the center. FIG. 8C shows the overlap between the transmitting portion 16*a* and the light receiving elements 18*b*2 at an end. In FIG. 8C, the tilt (shift) of the transmitting portion 16*a* with respect to the light receiving elements 18*b*2 becomes large, and the brightness contrast of light input to the light receiving elements 18*b* tends to deteriorate.

Figure 9:
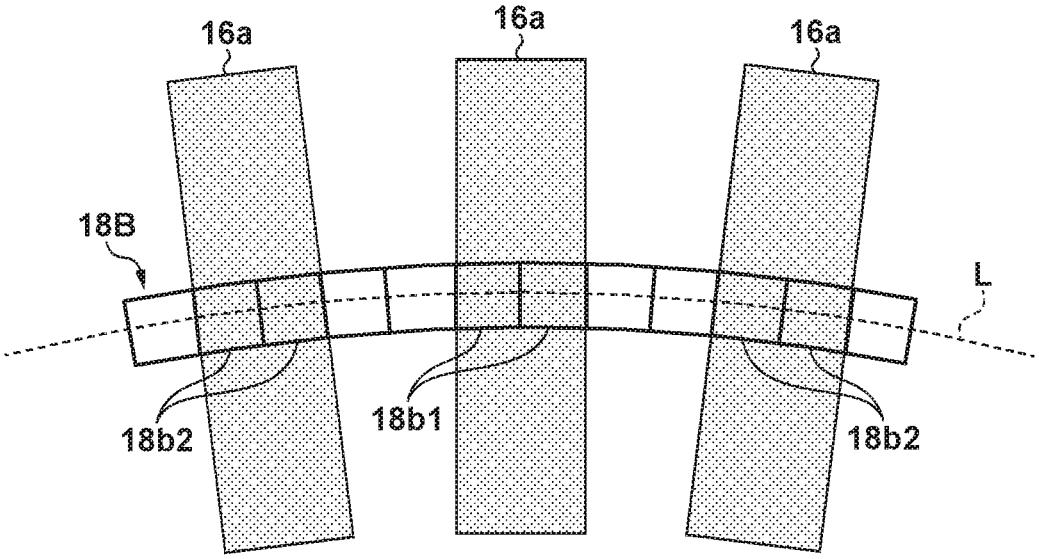
FIG. 9 is an explanatory view of a light receiving element array.

On the other hand, when the plurality of light receiving elements 18*b* are arranged in an arc in the circumferential direction of the code wheel 16, as shown in FIG. 7C, a state as shown in FIG. 9 is obtained. That is, the tilt (shift) of the transmitting portion 16*a* with respect to the light receiving elements 18*b*2 at an end of the light receiving element array 18B is the same as that for the light receiving elements 18*b*1 at the center. It is therefore possible to suppress deterioration of the brightness contrast of light input to the light receiving elements 18*b*.

When the plurality of light receiving elements 18*b* are arranged in an arc, the light receiving elements 18*b* can be arranged on the optical read circle L (on the virtual circle with respect to the rotation center of the code wheel 16 as the center), as shown in FIG. 9. In other words, the curvature of the arc of the plurality of light receiving elements 18*b* can be set in accordance with the radius of the optical read circle L. However, when the plurality of light receiving elements 18*b* are arranged along the circumferential direction of the code wheel 16 in an arc projecting outward in the radial direction of the code wheel 16, the effect of suppressing deterioration of the brightness contrast can be obtained without making the center or curvature of the arc of the plurality of light receiving elements 18*b* match the optical read circle L.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-041777, filed Mar. 3, 2015, which is hereby incorporated by reference herein in its entirety.

What is claimed is:

1. A printing apparatus comprising:

a conveyance roller configured to convey a print medium in a first direction;

a printhead configured to print an image on the print medium conveyed by the conveyance roller;

a carriage mounting the printhead and configured to move in a second direction which intersects the first direction; and a rotary encoder including a code wheel provided coaxially with the conveyance roller and configured to detect a rotation amount of the conveyance roller, wherein the carriage includes a cutout portion in a side portion, and the carriage is configured to move to a position at which the carriage overlaps the code wheel at the cutout portion in a direction perpendicular to the second direction.

2. The apparatus according to claim 1, wherein the printhead prints the image by discharging ink to the print medium, the carriage mounts an ink tank which stores ink supplied to the printhead, and the carriage is configured to move to the position at which the ink tank overlaps the code wheel in the direction perpendicular to the second direction.

3. The apparatus according to claim 1, wherein the printhead can print the image on the print medium when the carriage is located at the position.

4. The apparatus according to claim 1, wherein a diameter of the code wheel is not more than 35 mm.

5. The apparatus according to claim 1, wherein a resolution of the rotary encoder is not less than 300 LPI.

6. The apparatus according to claim 1, wherein the cutout portion is arcuate.

7. The apparatus according to claim 1, further comprising a power transmission member provided coaxially with the conveyance roller and configured to transmit a driving force to the conveyance roller, wherein the power transmission member is arranged outside the code wheel in the second direction, and the carriage is configured to move to the position at which the carriage overlaps the power transmission member in the direction perpendicular to the second direction.

8. A printing apparatus comprising:

a conveyance roller configured to convey a print medium in a first direction;

a printhead configured to print an image on the print medium conveyed by the conveyance roller;

a carriage mounting the printhead and configured to move in a second direction which intersects the first direction; and a rotary encoder including a code wheel provided coaxially with the conveyance roller, a light emitting element which irradiates the code wheel with light, and a plurality of light receiving elements which receive the light through the code wheel and are arranged in an arc in a circumferential direction of the code wheel.

9. The apparatus according to claim 8, wherein the plurality of light receiving elements are arranged on a virtual circle with respect to a rotation center of the code wheel as a center.

10. A control method of a printing apparatus, which includes a conveyance roller configured to convey a print medium in a first direction; a printhead configured to print an image on the print medium conveyed by the conveyance roller; a carriage mounting the printhead and configured to move in a second direction which intersects the first direction; and a rotary encoder including a code wheel provided coaxially with the conveyance roller and configured to detect a rotation amount of the conveyance roller, the carriage including a cutout portion in a side portion, the method comprising:

moving the carriage in the second direction; and printing the image on the print medium by the printhead, wherein in the moving, when at least a predetermined condition is met, the carriage is moved to a position at which the carriage overlaps the code wheel at the cutout portion in a direction perpendicular to the second direction.

11. A printing apparatus comprising:

a conveyance roller configured to convey a print medium in a first direction;

a printhead configured to print an image on the print medium conveyed by the conveyance roller;

a carriage mounting the printhead and configured to move in a second direction which intersects the first direction; and a rotary encoder including a code wheel provided coaxially with the conveyance roller and configured to detect a rotation amount of the conveyance roller, wherein the carriage includes a cutout portion in a side portion, the cutout portion is arranged so as to overlap the code wheel as viewed in the second direction, and the carriage is configured to move to a position at which the cutout portion overlaps the code wheel as viewed in a direction perpendicular to the second direction.

12. The apparatus according to claim 11, wherein the printhead prints the image by discharging ink to the print medium, the carriage mounts an ink tank which stores ink supplied to the printhead, and the carriage is configured to move to the position, at which the ink tank overlaps the code wheel in the second direction.

13. The apparatus according to claim 11, wherein the printhead can print the image on the print medium when the carriage is located at the position.

14. The apparatus according to claim 11, wherein the rotary encoder further includes a light emitting element which irradiates the code wheel with light, and a plurality of light receiving elements which receive the light through the code wheel and are arranged in an arc in a circumferential direction of the code wheel.

15. The apparatus according to claim 14, wherein the plurality of light receiving elements are arranged on a virtual circle with respect to a rotation center of the code wheel as a center.

16. The apparatus according to claim 11, wherein a diameter of the code wheel is not more than 35mm.

17. The apparatus according to claim 11, wherein a resolution of the rotary encoder is not less than 300 LPI.

18. The apparatus according to claim 11, wherein the cutout portion is of an arcuate shape.

19. The apparatus according to claim 11, further comprising a power transmission member provided coaxially with the conveyance roller and configured to transmit a driving force to the conveyance roller, wherein the power transmission member is arranged outside the code wheel in the second direction of the conveyance roller, the carriage is configured to move to the position, at which the cutout portion overlaps the power transmission member when viewed in the direction perpendicular to the second direction.

* * * * *